US011133619B2

(12) United States Patent
Demaratos

(10) Patent No.: US 11,133,619 B2
(45) Date of Patent: Sep. 28, 2021

(54) METHOD FOR IMPROVING CLEARANCE AND CREEPAGE IN A HIGH VOLTAGE CONNECTOR ASSEMBLY USING A FEMALE TERMINAL POSITION ASSURANCE (TPA) DEVICE

(71) Applicant: J.S.T. CORPORATION, Farmington Hills, MI (US)

(72) Inventor: David Demaratos, Wixom, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/855,790

(22) Filed: Apr. 22, 2020

(65) Prior Publication Data

US 2020/0274281 A1 Aug. 27, 2020

Related U.S. Application Data

(62) Division of application No. 16/389,926, filed on Apr. 20, 2019, now Pat. No. 10,892,579.

(Continued)

(51) Int. Cl.
*H01R 13/436* (2006.01)
*H01R 43/20* (2006.01)

(Continued)

(52) U.S. Cl.
CPC ..... *H01R 13/436* (2013.01); *H01R 13/424* (2013.01); *H01R 13/4362* (2013.01);

(Continued)

(58) Field of Classification Search
CPC ..... H01R 13/4223; H01R 13/4365; H01R 13/4362; H01R 13/4368; H01R 13/436;

(Continued)

(56) References Cited

U.S. PATENT DOCUMENTS 4,984,998 A 1/1991 Duncan
5,738,543 A 4/1998 Rollins (Continued)

FOREIGN PATENT DOCUMENTS

DE 102014108283 A1 12/2015
WO 2018/215026 A1 11/2018

OTHER PUBLICATIONS

Demaratos, David et al.; Related Copending U.S. Appl. No. 16/854,563, filed Apr. 21, 2020.

(Continued)

*Primary Examiner* — Gary F Paumen
(74) *Attorney, Agent, or Firm* — Kratz. Quintos & Hanson, LLP

(57) ABSTRACT

A method for improving clearance and creepage in a high voltage connector assembly using a female terminal position assurance (TPA) device. The female housing in this invention is highly suitable for high voltage electrical terminals, which are larger terminals. The female TPA device in this invention includes two frontward extending members, while the female housing includes a front portion for terminals to reside. With the above-described characteristics of this invention, the creepage and the clearance of an electrical path between one terminal to another terminal are advantageously increased. The electrical path one of the a electric high voltage electrical terminal to another high voltage electrical terminal extending along the front portion of the female housing and between the front downward extending members of the frontward extending members of the female TPA device.

7 Claims, 7 Drawing Sheets

Related U.S. Application Data

(60) Provisional application No. 62/810,179, filed on Feb. 25, 2019.

(51) Int. Cl.
*H01R 13/424* (2006.01)
*H01R 13/502* (2006.01)
*H01R 13/629* (2006.01)
*H01R 13/639* (2006.01)

(52) U.S. Cl.
CPC ..... *H01R 13/502* (2013.01); *H01R 13/629* (2013.01); *H01R 13/639* (2013.01); *H01R 43/20* (2013.01)

(58) Field of Classification Search
CPC .. H01R 13/424; H01R 13/502; H01R 13/629; H01R 13/639; H01R 43/20
USPC ..... 439/595, 752
See application file for complete search history.

(56) References Cited

U.S. PATENT DOCUMENTS

| | | | | |
|---|---|---|---|---|
| 5,890,935 | A | 4/1999 | Pill | |
| 5,967,859 | A | 10/1999 | Cecil | |
| 6,004,158 | A | 12/1999 | Ward | |
| 6,024,591 | A | 2/2000 | Foster | |
| 6,083,014 | A | 7/2000 | Bogdan | |
| 7,165,995 | B2 | 1/2007 | Fukushima | |
| 7,614,910 | B2 | 11/2009 | Croteau | |
| 7,632,148 | B1 | 12/2009 | Kawamura | |
| 7,811,105 | B1 | 10/2010 | Yaw | |
| 10,153,586 | B1 | 12/2018 | Schroll | |
| 10,892,579 | B2 * | 1/2021 | Demaratos | H01R 13/629 |
| 2003/0077947 | A1 * | 4/2003 | Sugimori | H01R 13/53 439/686 |
| 2004/0106325 | A1 | 6/2004 | Miyazaki | |
| 2005/0215122 | A1 | 9/2005 | Nishida | |
| 2007/0123065 | A1 * | 5/2007 | Rosenfeldt | H01R 12/721 439/62 |
| 2009/0311896 | A1 | 12/2009 | Myer | |
| 2010/0105254 | A1 | 4/2010 | Park | |
| 2010/0261364 | A1 | 10/2010 | Matsuoka | |
| 2010/0279555 | A1 | 11/2010 | Azad | |
| 2011/0207357 | A1 | 8/2011 | Dick | |
| 2013/0017719 | A1 | 1/2013 | Tanaka | |
| 2014/0287631 | A1 | 9/2014 | Tashiro | |
| 2016/0013575 | A1 | 1/2016 | Campbell | |
| 2016/0329651 | A1 | 11/2016 | Yamaguchi | |
| 2017/0338600 | A1 | 11/2017 | Tanaka | |
| 2018/0316131 | A1 | 11/2018 | Holub | |
| 2019/0173220 | A1 | 6/2019 | Bhat | |

OTHER PUBLICATIONS

International Search Report of the International Searching Authority for International Application No. PCT/US2019/029535 dated Jul. 3, 2019 (2 sheets).
Office Action of U.S. Appl. No. 16/370,069 dated Apr. 4, 2020.
Written Opinion of the International Searching Authority for International Application No. PCT/US2020/015929 dated Apr. 20, 2020 (6 sheets).
International Search Report for International Application No. PCT/US2020/015929 dated Apr. 20, 2020 (2 sheets).
International Preliminary Reporton Patentability for International Application No. PCT/US2019/062861 dated Apr. 21, 2020 (12 sheets).

* cited by examiner

METHOD FOR IMPROVING CLEARANCE AND CREEPAGE IN A HIGH VOLTAGE CONNECTOR ASSEMBLY USING A FEMALE TERMINAL POSITION ASSURANCE (TPA) DEVICE

CROSS-REFERENCE TO RELATED APPLICATIONS

This patent application is a Divisional Application of U.S. Patent Application having U.S. Ser. No. 16/389,926 filed on Apr. 20, 2019, which claims priority to U.S. Provisional Patent Application having U.S. Ser. No. 62/810,179 filed Feb. 25, 2019, the entire contents of which are incorporated herein by reference in their entireties.

BACKGROUND OF THE INVENTION

Due to the high voltage that a high voltage connector assembly is required to meet and due to the design of traditional shielded automotive connectors, it is desired that clearance and creepage from at least a high voltage electrical terminal to another high voltage electrical terminal, to an electrical element/circuit, be improved or increased.

SUMMARY OF THE INVENTION

This invention is directed to a method for improving clearance and creepage in a high voltage connector assembly using a female terminal position assurance (TPA) device and housing. The high voltage connector assembly in this invention is highly suitable for high voltage electrical terminals, which are larger terminals. The female TPA device in this invention includes frontward extending members, while the female housing includes a front portion and rear portions. With the above-described characteristics of this invention, "creepage" (a measurement of the shortest path along the surface from any given circuit in a connector to any (usually adjacent) other circuit), and "clearance" (defined as, e.g., a measurement of the shortest electrical path from any exposed electrically conducting element in a given circuit of a connector to any other electrically conducting element in a different circuit in the same connector) are advantageously increased.

DETAILED DESCRIPTION OF THE PREFERRED EMBODIMENTS

Figure 1:
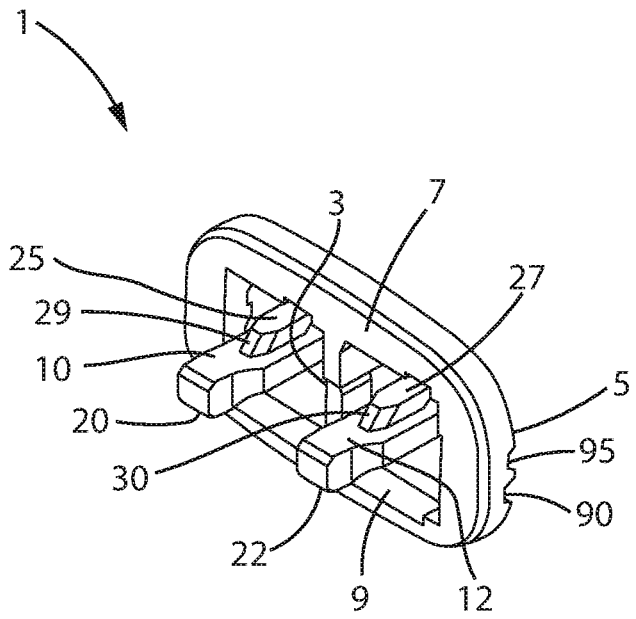
FIG. 1 is a front perspective view of a female terminal position assurance (TPA) device of this invention for use in a female high voltage connector assembly.

FIG. 1 illustrates a front perspective view of the female terminal position (TPA) device, generally referred to as reference numeral 1. The female TPA device 1 includes a middle member 3 and a rounded member 5. The middle member 3 extends from an upper portion 7 to a lower portion 9 of the rounded member 5. The rounded member 5 has, on opposite sides thereof, frontward extending members 10, 12 extending therefrom.

Figure 2:
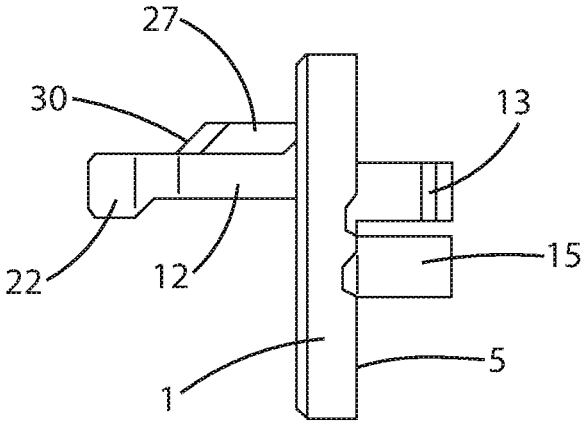
FIG. 2 is a side elevational view of the female TPA device of this invention.

Illustrated in FIG. 2 are an upper backward extending member 13 and a lower backward extending member 15. At a front end of each of the frontward extending members 10, 12 is a corresponding front downward extending member 20, 22. Also each of the frontward extending members 10, 12 has a corresponding upper member 25, 27; and each of the upper members 25, 27 has a corresponding ramp-like front end 29, 30.

Figure 3:
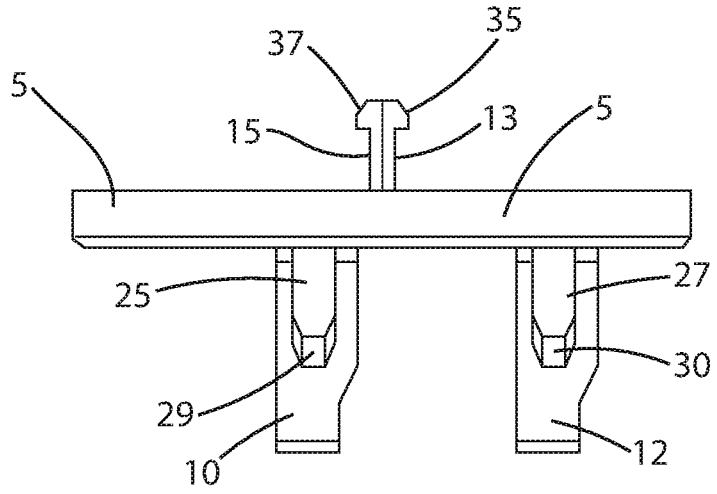
FIG. 3 is a top elevational view of the female TPA device of this invention.
Figure 4:
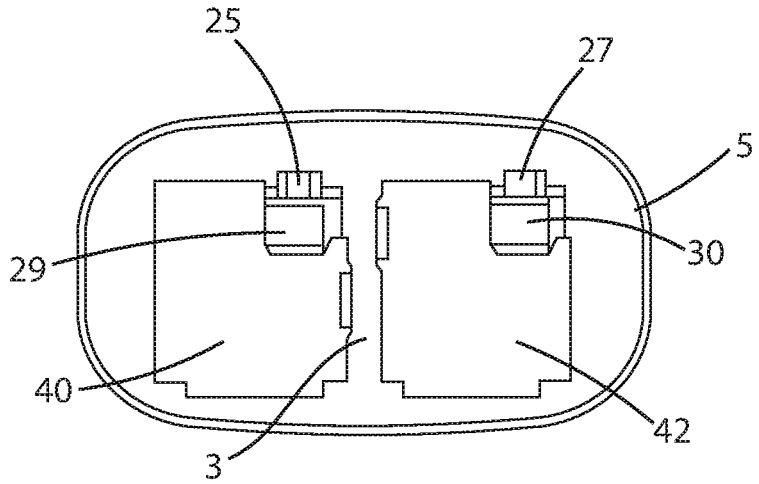
FIG. 4 is a front elevational view of the female TPA device of this invention.

Shown in FIG. 3 is a top elevational view of the female TPA device 1, which illustrates the frontward extending members 10, 12, the corresponding upper members 25, 27 respectively extending therefrom, and the ramp-like front ends 29, 30, respectively, thereof. Also shown are the upper backward extending member 13 and the lower backward extending member 15. The upper backward extending member 13 has an upper barb-like member 35 extending therefrom, while the lower backward extending member 15 has a lower barb-like member 37 extending therefrom. Passing through both sides of the female TPA device 1 are openings 40, 42 with the middle member 3 therebetween, as shown in FIG. 4.

Figure 5:
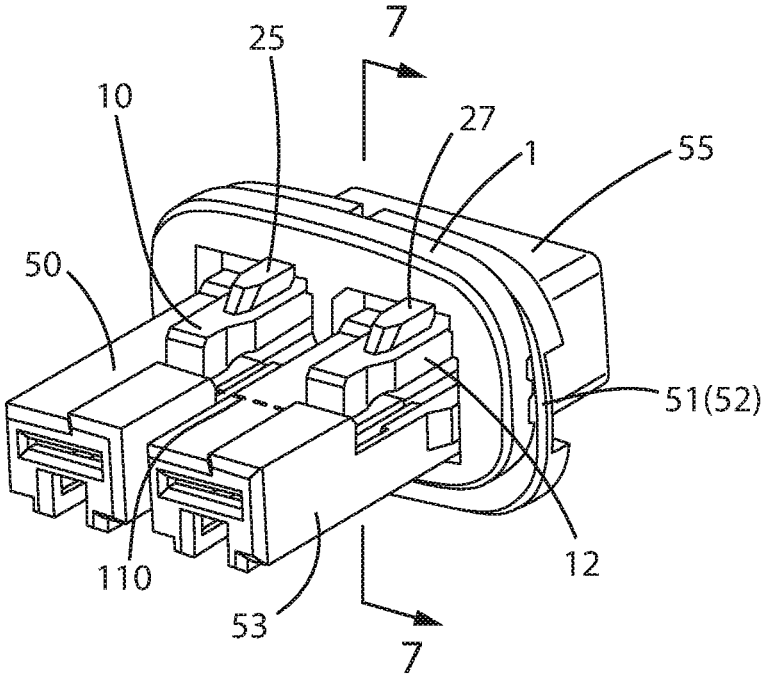
FIG. 5 is a perspective view of the female TPA device of this invention fitted or installed, in a female housing, at a pre-lock position, and further illustrating thereon on the female housing a clearance or creepage for an electrical path from a high voltage electrical terminal to another high voltage electrical terminal.
Figure 6:
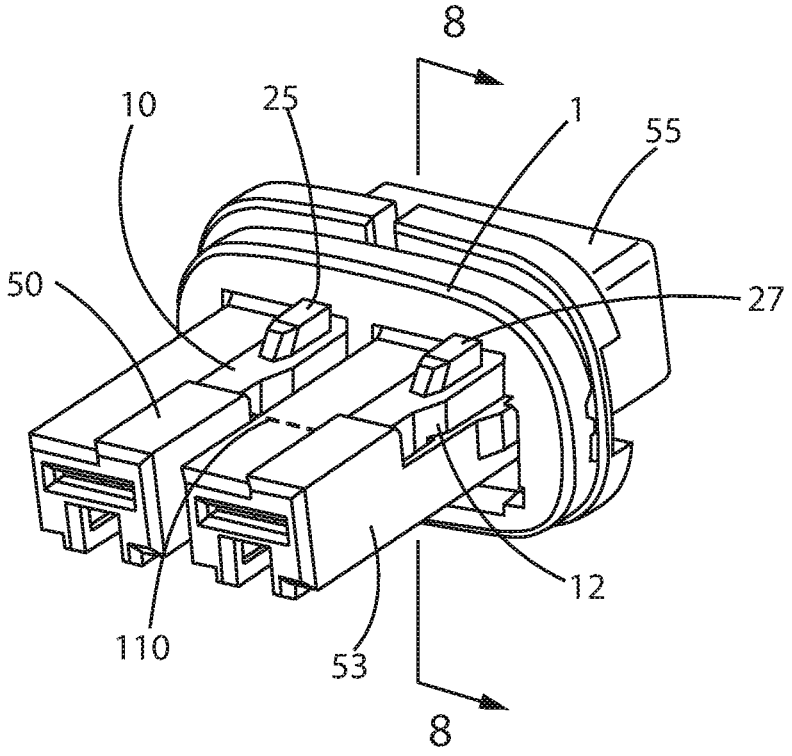
FIG. 6 is a perspective view of the female TPA device of this invention fitted or installed, in a female housing, at a full-lock position, and further illustrating thereon on the female housing the clearance or creepage for the electrical path from the high voltage electrical terminal to another high voltage electrical terminal.

FIG. 5 illustrates the female TPA device in a pre-lock position while inserted into and mounted onto a female housing 50. The female housing 50 has a front portion 53 and a rear portion 55. FIG. 6 illustrates the female TPA device 1 in a full-lock position while inserted into and mounted onto the female housing 50.

This invention is directed to a method for improving clearance and creepage using the female TPA device 1. This invention is also highly suitable for high voltage electrical terminals 60, which are larger terminals. Further illustrated in each of FIGS. 5 and 6, on the female housing 50, and around the female TPA device 1 is a clearance or creepage, for an electrical path 110, from an exposed high voltage electrical terminal 60 extending along and across the top surface of front portion 53 of the female housing 50, and extending toward another exposed high voltage electrical terminal 60 inside the front portion 53.

With the above-described characteristics of this invention, as described above and shown in FIGS. 5 and 6, the "creepage" (a measurement of the shortest electrical path along the surface from any given circuit, here one of a high voltage electrical terminals 60, traveling in a direction or extending along the surface, here the surface of the frontward extending members 10, 12 of the female TPA device 1 and top surface of front portion 53 of the female housing 50, to any (usually adjacent) other circuit, here another high voltage electrical terminal 60), and the "clearance" (a measurement of the shortest electrical path from any exposed electrically conducting element, here a high voltage electrical terminal 60, in a given circuit of a connector to any other electrically conducting element in a different circuit in the same connector, here another high voltage electrical terminal 60) are advantageously increased.

Figure 7:
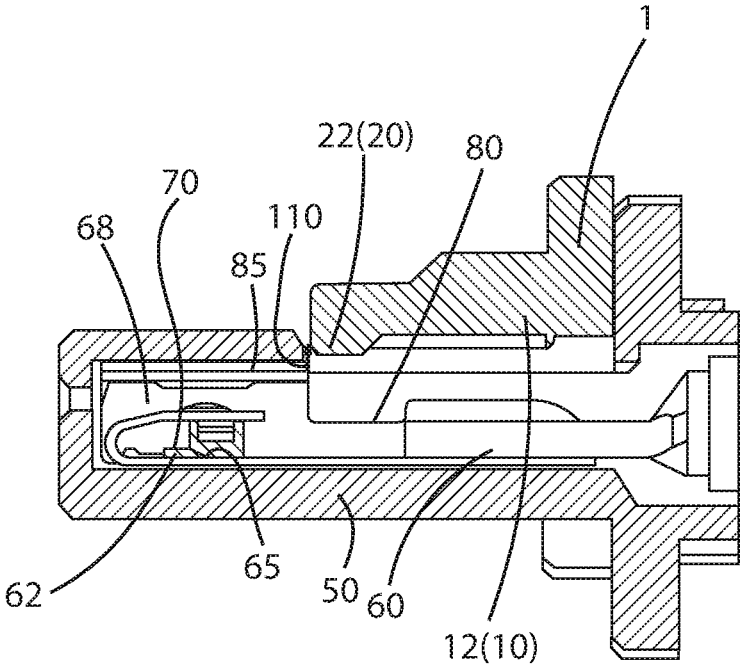
FIG. 7 is a cross-sectional view taken along cross-sectional line 7-7 in FIG. 5 showing a corresponding high voltage terminal with a corresponding front downward extending member of a corresponding frontward extending member of the female TPA device in a pre-lock position inside the female housing, and further illustrating the clearance or creepage for the electrical path extending from the high voltage electrical terminal, as shown in a vertical arrow.

As shown in FIG. 7, a protruding member 62 extends from a lower portion of the female housing 50. The protruding member 62 includes a ramp-like leading end 65. A leading portion 68 of the terminal 60, in turn, has a notch 70 such that when the terminal 60 is fully inserted into the female housing 50, the notch 70 readily passes over the ramp-like leading end 65 of the protruding member 62. Upon the terminal 60 being fully inserted into the female housing 50, the protruding member 62 of the female housing 50 snaps into the notch 70 of the leading end portion 68 of the terminal 60, thereby locking (primary lock) the terminal 60 inside the female housing 50.

FIG. 7 further shows a cross-sectional view taken along line 7-7 in FIG. 5, wherein the female TPA device 1 is at a pre-lock position. As discussed above, the terminal 60 is locked (primary lock) when the protruding member 62 inside the female housing 50 snaps into or enters the notch 70 of the leading end portion 68 of the terminal 60. Consequently, the terminal 60 cannot be pulled out from the female housing 50; and such time, an upper notch 80 of the terminal 60 becomes available for receiving or accommodating therein a corresponding one of the front downward extending members 20, 22. That is, unless the terminal 60 is in the primary lock inside the female housing 50 and the upper notch 80 of the terminal 60 is available to receive or accommodate therein a corresponding one of the front downward extending members 20, 22, the front downward extending members 20, 22 are unable to provide the necessary secondary lock to the terminal 60 inside the female housing 50. In other words, if the terminal 60 is not in the primary lock inside the female housing 50, the female TPA device 1 is prevented, by an upper portion 85 of the leading portion 68 of the terminal 60, from being further pushed downward. Consequently, if the upper portion 85 of the leading portion 68 of the terminal 60 blocks the female TPA device 1 (more particularly, blocks the front downward extending members 20, 22 of the female TPA device 1), the female TPA device 1 is able to detect that it is unable to be further pushed downward, and therefore unable to provide the secondary lock for the terminal 60 inside the female housing 50 (i.e., the female TPA device 1 cannot be further pushed downward to the full-lock position).

Figure 8:
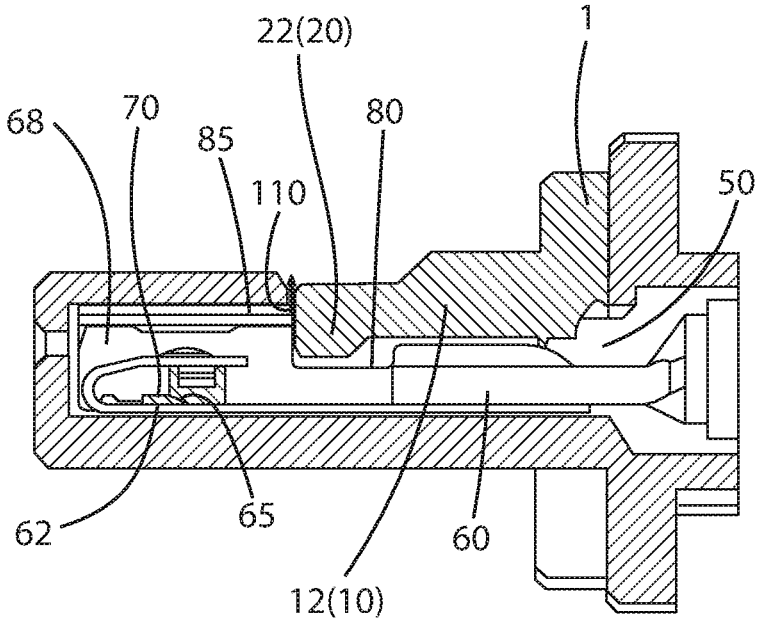
FIG. 8 is a cross-sectional view taken along cross-sectional line 8-8 in FIG. 6 showing the corresponding high voltage terminal with the corresponding front downward extending member of the corresponding frontward extending member of the female TPA device in a full-lock position inside the female housing, and further illustrating the clearance or creepage for the electrical path extending from the high voltage electrical terminal, as shown in a vertical arrow.

FIG. 8 illustrates the female TPA device 1 being in the full-lock position inside the female housing 50. Here, the upper notch 80 of the terminal 60 becomes available for accommodating therein the corresponding one of the front downward extending members 20, 22 of the female TPA device 1; and therefore, when inserted inside a respective one of the upper notches 80 of the terminals 60, the front downward extending members 20, 22 of the female TPA device 1 respectively block the terminals 60 from being pulled out from the inner housing 50, and thus able to provide the secondary lock for the terminals 60 inside the female housing 50.

As further shown in each of FIG. 7 pre-lock female TPA device 1 and FIG. 8 full-lock female TPA device 1, as the female TPA device 1 is oriented on or into the female housing 50, the creepage or clearance for the electrical path 110 (see, arrow) is shown, substantially extending vertically, from the high voltage electrical terminal 60, further along or between a corresponding one of the front downward extending members 20, 22 (of the frontward extending members 10, 12, respectively of the female TPA device 1) and along a vertical and or substantially slanted or angled portion or portions of the front portion 53 of the female housing 50. The front downward extending members 20, 22 are substantially directly behind a portion of the corresponding high voltage electrical terminals 60, respectively.

Figure 9:
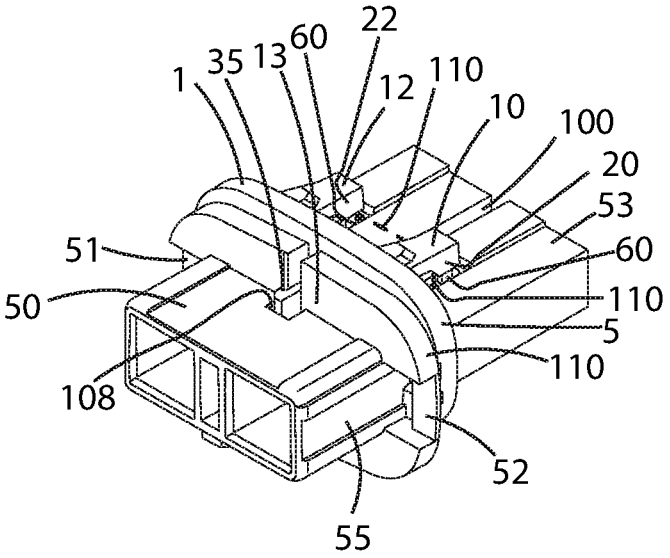
FIG. 9 illustrates the clearance or creepage for the electrical path extending from the high voltage electrical terminal, as shown in a vertical arrow, and further extending across the female housing and into another high voltage electrical terminal, as shown in the dashed lines, and further extending into another high voltage electrical terminal.

Illustrated in, for example, FIG. 9, the female TPA device 1 is in the pre-lock position in the female housing 50. Shown in FIG. 9 are the frontward extending members 10, 12 of the female TPA device 1, above and partially inserted into the front portion 53 of the female housing 50. In FIG. 9, the creepage or clearance for the electrical path 110 (see, arrow) is shown, substantially extending vertically, from one of the high voltage electrical terminals 60, further exiting partially along or between one of the front downward extending members 20 (of the frontward extending members 10, respectively of the female TPA device 1) and exiting along and from a vertical and or substantially slanted or angled portion or portions of the front portion 53 of the female housing 50, further traveling in a direction or extending along and across the top surface the front portion 53 of the female housing 50 and further substantially extending vertically, into another one of high voltage electrical terminals 60, along or between one of the front downward extending members 22 (of the frontward extending members 10, 12, respectively of the female TPA device 1) and along a vertical and or substantially slanted or angled portion or portions of the front portion 53 of the female housing 50 (see, FIG. 6), the above also having the order vice versa between the terminals 60, and the above also additionally present in a full-lock orientation of the female TPA device 1 with female housing 50 (see, FIGS. 6, 8).

The present invention is not limited to the above-described embodiments; and various modifications in design, structural arrangement or the like may be used without departing from the scope or equivalents of the present invention.

I claim:

1. A method for improving clearance and creepage in a high voltage connector assembly using a female terminal position assurance (TPA) device in a female housing of a high voltage connector assembly, said TPA device having a locking portion and a remaining portion, said method comprising the steps of:

inserting at least two high voltage electrical terminals in a terminal installation direction inside said female housing of said high voltage connector assembly;

locking said high voltage electrical terminals inside said female housing of said high voltage connector assembly and after said high voltage electrical terminals have been locked inside said female housing, providing a space in said female housing, through which said high voltage electrical terminals are inserted, for accommodating therein said locking portion of said female TPA device;

inserting said locking portion of said female TPA device into said space of said female housing towards a locking portion inserting direction that is substantially perpendicular to said terminal installation direction, wherein said step of inserting said locking portion of said female TPA device into said space includes a step of additionally locking said high voltage electrical terminals inside said female housing by said female TPA device and allowing said remaining portion of said TPA device to re outside of said female housing; and allowing a clearance or creepage for an electrical path to extend from one of said high voltage electrical terminals o another one of said high voltage electrical terminals along at least a portion of said space along or between said locking portion of said TPA device and said female housing; and allowing said clearance or creepage for an electrical path to extend from a vertical or substantially slanted or angled portion of a front portion of said female housing.

2. The method for improving clearance and creepage in said high voltage connector assembly using said female TPA device in said female housing of said high voltage connector assembly in accordance to claim 1, wherein said step of allowing said clearance or creepage for said electrical path includes a step of extending said electrical path substantially vertically from said one high voltage electrical terminal across a top portion of said female housing, and further extending substantially vertically into said another one of said high voltage electrical terminal.

3. The method for improving clearance and creepage in said high voltage connector assembly using said female TPA device in said female housing of said high voltage connector assembly in accordance to claim 1, wherein said step of inserting said female TPA device into said female housing includes a step of locking said female TPA device to said female housing at a pre-lock position.

4. The method for improving clearance and creepage in said high voltage connector assembly using said female TPA device in said female housing of said high voltage connector assembly in accordance to claim 1, wherein said step of inserting said female TPA device into said female housing includes the step of locking said female TPA device to said female housing at a full-lock position.

5. The method for improving clearance and creepage in said high voltage connector assembly using said female TPA device in said female housing of said high voltage connector assembly in accordance to claim 2, wherein said female TPA device includes extending members respectively extending downwards from frontward extending members, and. wherein said female housing includes a front portion.

6. The method for improving clearance and creepage in said high voltage connector assembly using said female TPA device in said female housing of said high voltage connector assembly in accordance to claim I, wherein said space is between a corresponding one of front downward extending members of said female TPA device and a corresponding one of front portions of said female housing.

7. A method for improving clearance and creepage in a high voltage connector assembly using a female terminal position assurance (TPA) device in a female housing of a high voltage connector assembly, comprising the steps of:

inserting at least two high voltage electrical terminals inside said female housing of said high voltage connector assembly;

locking said high voltage electrical terminals inside said female housing of said high voltage connector assembly and after said high voltage electrical terminals have been locked inside said female housing, providing a space in said female housing for accommodating therein said female TPA device;

inserting said female TPA device into said space of said female housing, wherein said step of inserting said female TPA device into said space includes a step of additionally locking said high voltage electrical terminals inside said female housing by said female TPA device, allowing a clearance or creepage for an electrical path to extend from one of said high voltage electrical terminals to another one of said high voltage electrical terminals along at least a portion of said space along or between a front downward extending member of a frontward extending member of said female TPA device and said female housing, allowing said clearance or creepage for an electrical path to extend from a vertical or substantially slanted or angled portion of a front portion of said female housing, allowing said clearance or creepage for an electrical path to extend along and across a top surface of said front portion of said female housing; and allowing said clearance or creepage for an electrical path to extend vertically into said another one of said high voltage electrical terminals along or between another one of said front downward extending member of another one of said frontward extending member of said female TPA device.

* * * * *